US009580261B2

(12) United States Patent
Nakagaki

(10) Patent No.: US 9,580,261 B2
(45) Date of Patent: Feb. 28, 2017

(54) CONVEYING APPARATUS, IMAGE FORMING APPARATUS, AND CONVEYING CONTROL METHOD

(71) Applicant: Toshihiro Nakagaki, Ibaraki (JP)

(72) Inventor: Toshihiro Nakagaki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/878,070

(22) Filed: Oct. 8, 2015

(65) Prior Publication Data

US 2016/0114993 A1 Apr. 28, 2016

(30) Foreign Application Priority Data

Oct. 22, 2014 (JP) ..... 2014-215397

(51) Int. Cl.

| | |
|---|---|
| ***B65H 5/26*** | (2006.01) |
| ***B65H 85/00*** | (2006.01) |
| ***G03G 15/23*** | (2006.01) |
| ***G03G 15/00*** | (2006.01) |

(52) U.S. Cl.

CPC ..... *B65H 5/26* (2013.01); *B65H 85/00* (2013.01); *G03G 15/234* (2013.01); *G03G 15/6508* (2013.01); *G03G 15/6564* (2013.01); *B65H 2301/33312* (2013.01); *B65H 2301/4454* (2013.01); *B65H 2301/4491* (2013.01); *B65H 2801/06* (2013.01)

(58) Field of Classification Search

CPC ..... B65H 5/26; B65H 85/00; G03G 15/234
See application file for complete search history.

(56) References Cited

U.S. PATENT DOCUMENTS

| | | | | |
|---|---|---|---|---|
| 5,532,793 A * | 7/1996 | Kogure | ..... | G03G 15/234 271/184 |
| 6,323,939 B1 * | 11/2001 | Suzuki | ..... | G03G 15/234 355/23 |
| 6,393,252 B1 | 5/2002 | Yamagishi | | |

(Continued)

FOREIGN PATENT DOCUMENTS

| | | |
|---|---|---|
| JP | 2001-326785 | 11/2001 |
| JP | 2008-100831 | 5/2008 |

(Continued)

*Primary Examiner* — Jeremy R Severson
(74) *Attorney, Agent, or Firm* — IPUSA, PLLC

(57) ABSTRACT

A conveying apparatus includes a first conveying unit that conveys a recording medium, a reversing unit that reverses the recording medium conveyed by the first conveying unit, a second conveying unit that conveys the recording medium from the reversing unit to the first conveying unit, and a first supply unit and a second supply unit that supply the recording medium to the second conveying unit at different supply positions. When sequentially reversing/conveying multiple sheets of the recording medium, a control unit alternately conveys the recording medium that has been reversed by the reversing unit and the recording medium that is supplied from the first or second supply unit after a predetermined number of sheets of the recording medium have been reversed by the reversing unit, and changes the predetermined number depending on whether the recording medium is supplied from the first supply unit or the second supply unit.

7 Claims, 7 Drawing Sheets

(56) References Cited

U.S. PATENT DOCUMENTS

| | | | | |
|---|---|---|---|---|
| 6,477,352 | B2 * | 11/2002 | Takahashi | G03G 15/234 399/401 |
| 6,782,236 | B2 * | 8/2004 | Sasaki | G03G 15/234 271/184 |
| 6,836,640 | B2 * | 12/2004 | Isemura | G03G 15/6561 271/265.01 |
| 7,389,084 | B2 * | 6/2008 | Watanabe | G03G 15/6558 271/3.01 |
| 8,905,401 | B2 | 12/2014 | Nakagaki | |
| 9,096,398 | B2 | 8/2015 | Nakagaki | |

FOREIGN PATENT DOCUMENTS

| | | |
|---|---|---|
| JP | 2013-249171 | 12/2013 |
| JP | 2014-043338 | 3/2014 |

* cited by examiner

CONVEYING APPARATUS, IMAGE FORMING APPARATUS, AND CONVEYING CONTROL METHOD

BACKGROUND OF THE INVENTION

1. Field of the Invention

The present invention relates to a conveying apparatus, an image forming apparatus, and a conveying control method.

2. Description of the Related Art

The so-called interleaf control system is a known technique that may be implemented in the case of performing sequential duplex printing on a plurality of sheets of recording medium in an image forming apparatus such as a copier, for example. The interleaf control system involves printing an image on a first side of a sheet of recording medium, and then alternately printing an image on a first side of a newly fed sheet of recording medium and printing an image on a second side of the sheet that already has an image printed on its first side.

In such interleaf control system, a plurality of sheets of recording medium that already have images printed on their first sides are arranged to await printing at a duplex conveying path, and the sheets of recording medium having images printed on their first sides and newly fed sheets of recording medium are alternatingly conveyed according to the print timing (see e.g. Japanese Laid-Open Patent Publication No. 2001-326785).

Note that some image forming apparatuses include a plurality of supply units that supply a recording medium to the duplex conveying path at different supply positions. In such case, the number of sheets of recording medium having images printed on their first sides that can be arranged to wait at the duplex conveying path may vary, and conveying control has to be adjusted depending on the supply unit that is supplying the recording medium.

SUMMARY OF THE INVENTION

An aspect of the present invention is directed to providing a conveying apparatus that is capable of optimizing conveying control with respect to each supply unit.

According to one embodiment of the present invention, a conveying apparatus is provided that includes a first conveying unit configured to convey a recording medium, a reversing unit configured to reverse the recording medium that is conveyed by the first conveying unit, a second conveying unit configured to convey the recording medium along a conveying path from the reversing unit to the first conveying unit, a first supply unit configured to supply the recording medium to the second conveying unit at a first supply position, a second supply unit configured to supply the recording medium to the second conveying unit at a second supply position, and a control unit configured to control the conveying apparatus. When sequentially reversing and conveying a plurality of sheets of the recording medium, the control unit controls the conveying apparatus to alternately convey the recording medium that has been reversed by the reversing unit and the recording medium that is supplied from the first supply unit or the second supply unit after a predetermined number of sheets of the recording medium have been reversed by the reversing unit. The control unit is configured to change the predetermined number depending on whether the recording medium is supplied from the first supply unit or the recording medium is supplied from the second supply unit.

DESCRIPTION OF THE PREFERRED EMBODIMENTS

Figure 1:
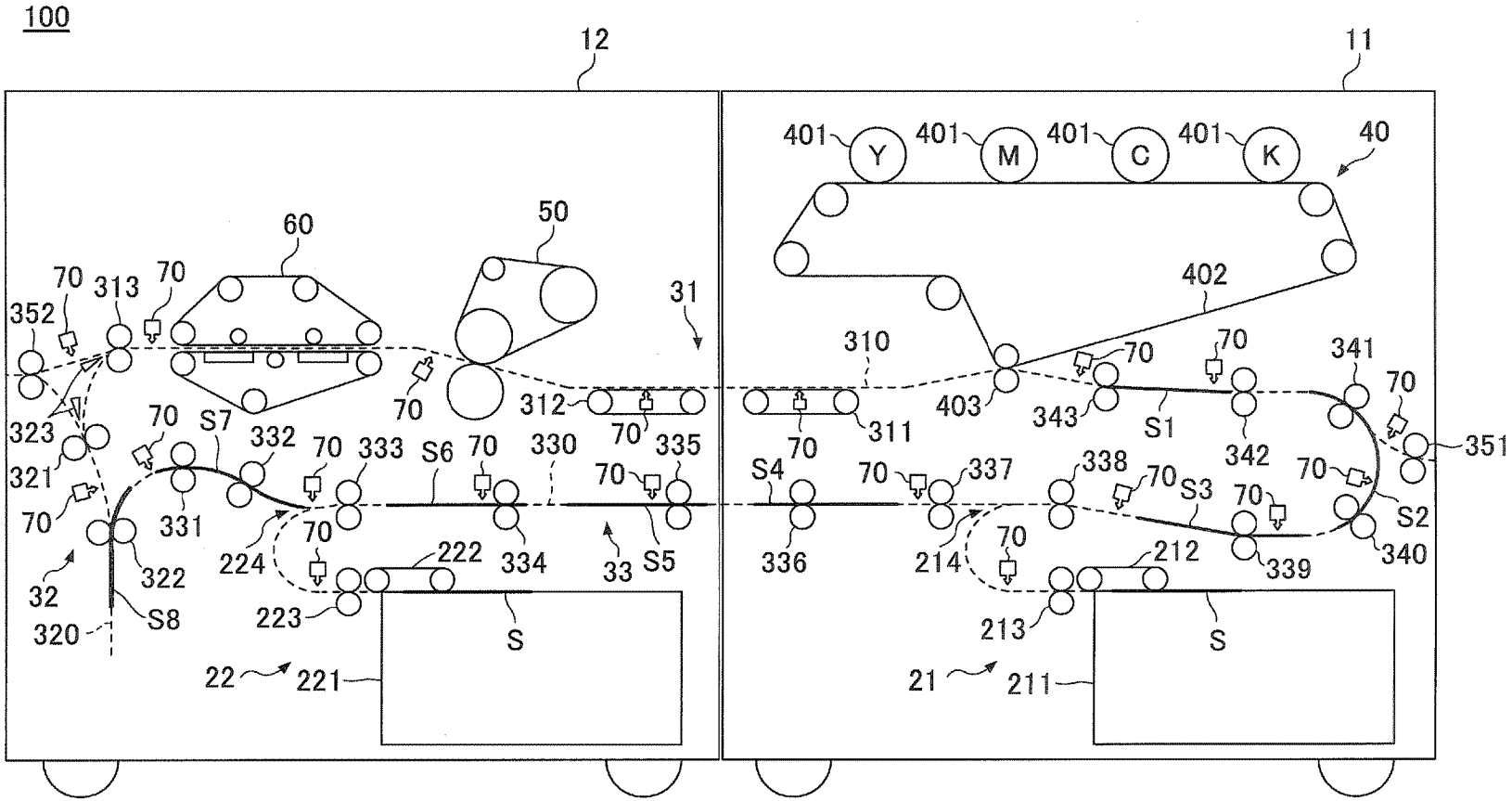
FIG. 1 is a diagram illustrating a schematic configuration of an image forming apparatus according to an embodiment of the present invention.

In the following, embodiments of the present invention are described with reference to the accompanying drawings. Note that elements illustrated in the drawings that have the same features are given the same reference numerals and overlapping descriptions thereof are omitted.

(Image Forming Apparatus)

FIG. 1 is a diagram illustrating a schematic configuration of an image forming apparatus 100 according to an embodiment of the present invention.

The image forming apparatus 100 according to the present embodiment is an electrophotographic copier that forms a full-color image on a sheet S corresponding to a recording medium. As illustrated in FIG. 1, the image forming apparatus 100 includes a first structure 11 and a second structure 12.

The first structure 11 includes a first sheet feeding unit 21 and an image forming unit 40. The second structure 12 includes a second sheet feeding unit 22, a reversing unit 32, a fixing unit 50, and a cooling unit 60. Also, the first structure 11 and the second structure 12 are connected to each other by a first conveying unit 31 and a second conveying unit 33 so that the sheet S may be conveyed within the first structure 11 and second structure 12 via the first conveying unit 31 and the second conveying unit 33.

The first sheet feeding unit 21 is an example of a first supply unit, and includes a sheet tray 211 for accommodating a plurality of sheets S, a sheet feeding belt 212 for separating and conveying the sheet S from the sheet tray 211, and a sheet feeding roller 213 for conveying the sheet S conveyed by the sheet feeding belt 212 to the second conveying unit 33. The first sheet feeding unit 21 supplies the sheet S to the second conveying unit 33 at a first sheet feeding position 214.

The second sheet feeding unit 22 is an example of a second supply unit, and includes a sheet tray 221 for accommodating a plurality of sheets S, a sheet feeding belt 222 for separating and conveying the sheet S from the sheet tray 221, and a sheet feeding roller 223 for conveying the sheet S conveyed by the sheet feeding belt 222 to the second conveying unit 33. The second feeding unit 22 supplies the sheet S to the second conveying unit 33 at a second sheet feeding position 224.

The first conveying unit 31 includes conveying belts 311 and 312 that are rotatably wound around a plurality of rollers, and a conveying roller pair 313 including one roller that rotates and drives the other roller to rotate. The first conveying unit 31 conveys the sheet S along a first conveying path 310 together with the fixing unit 50 and the cooling unit 60.

The reversing unit 32 includes conveying roller pairs 321 and 322 each including one roller that rotates and drives the other roller to rotate, and a bifurcating claw 323. The bifurcating claw 323 of the reversing unit 32 rotates and guides the sheet S to a reversing path 320, and the conveying roller pairs 321 and 322 convey the sheet S along the reversing path 320. In this way, the reversing unit 32 reverses the sheet S conveyed by the first conveying unit 31 from a front side to a reverse side (backside) and conveys the sheet S to the second conveying unit 33.

The second conveying unit 33 includes conveying roller pairs 331 to 343 each including one roller that rotates and drives the other roller to rotate. The second conveying unit 33 conveys the sheet S that is fed from the first sheet feeding unit 21 or the second sheet feeding unit 22, or the sheet S that is reversed by the reversing unit 32 along a second conveying path 330 to the first conveying unit 31.

The first conveying unit 31, the reversing unit 32, and the second conveying unit 33 have a plurality of sheet sensors 70 arranged along the first conveying path 310, the reversing path 320, and the second conveying path 330. Each sheet sensor 70 detects the sheet S that is being conveyed at its installation position, and the detection result is used for sheet conveying control, sheet jam detection, and the like.

The image forming unit 40 includes a plurality of photoconductors 401, an intermediate transfer belt 402, and a secondary transfer roller 403. Note that although the image forming unit 40 according to the present embodiment is configured to form an image on the sheet S using the electrophotographic method, in other embodiments, other image forming methods such as the inkjet method may be used to form an image on the sheet S.

The photoconductors 401 each include a charging device, a writing device, and a developing device (not shown), and are configured to form toner images on their surfaces in various colors including yellow, magenta, cyan, and black, for example.

The intermediate transfer belt 402 is an endless belt that is rotatably wound around a plurality of rollers. The toner images formed on the photoconductors 401 are transferred one on top of the other onto a surface of the intermediate transfer belt 402 such that a full-color toner image is formed on the surface.

The secondary transfer roller 403 transfers the full-color toner image formed on the intermediate transfer belt 402 on a first side or a second side of the sheet S conveyed by the second conveying unit 33.

The fixing unit 50 heats and applies pressure to the sheet S on which the full-color toner image has been transferred to fix the full-color toner image on the sheet S. The cooling unit 60 cools the sheet S that has been heated by the fixing unit 50.

In the image forming apparatus 100 according to the present embodiment, when performing single-sided printing, the sheet S that is fed from the first sheet feeding unit 21, the second sheet feeding unit 22, or a sheet feeding roller 351 is conveyed by the second conveying unit 33, and the image forming unit 40 forms a toner image on the first side of the sheet S. The sheet S having the toner image formed on its first side is conveyed by the first conveying unit 31 to pass through the fixing unit 50 and the cooling unit 60, after which the sheet S is discharged outside the apparatus by a discharge roller 352.

When performing duplex (double-sided) printing, the sheet S having an image formed on its first side as described above is reversed by the reversing unit 32 and conveyed to the second conveying unit 33, and the image forming unit 40 forms a toner image on the second side of the sheet S. The sheet S having the toner image formed on its second side is conveyed by the first conveying unit 31 to pass through the fixing unit 50 and the cooling unit 60 and be discharged outside the apparatus by the discharge roller 352 in a manner similar to the case of performing single-sided printing.

Note that in the case of performing sequential duplex printing on a plurality of sheets S in the image forming apparatus 100, interleaf control is performed that involves sequentially printing images on the first sides of a predetermined number of sheets S, and then alternating between printing an image on the second side of the sheet S that already has an image formed on its first side and printing an image on the first side of a sheet S that is newly fed.

The image forming apparatus 100 has a plurality of sheet standby positions for arranging the sheets S along the second conveying path 330 and the reversing path 320 such that the sheets S may be conveyed at the appropriate timing in accordance with the print timing of the image forming unit 40 during interleaf control. In FIG. 1, the image forming apparatus 100 can have a maximum of eight sheets S1-S8 waiting at the sheet standby positions arranged along the second conveying path 330 and the reversing path 320.

During interleaf control, a new sheet S that is fed from the first sheet feeding unit 21 or the second sheet feeding unit 22 is arranged between the plurality of sheets S that already have images printed on their first sides such that the sheet S already having an image printed on its first side and the newly fed sheet S are alternately conveyed to the image forming unit 40.

That is, in interleaf control, the sheets S1-S8 arranged to wait at the sheet standby positions along the second conveying path 330 and the reversing path 320 are successively conveyed to the image forming unit 40, starting from sheet S1, according to the print timing of the image forming unit 40. In this way, images are successively formed on the first side or the second side of the sheets S1-S8.

(Conveying Apparatus)

A conveying apparatus 200 according to the present embodiment includes the first sheet feeding unit 21, the second sheet feeding unit 22, the first conveying unit 31, the reversing unit 32, the second conveying unit 33, and the sheet sensor 70 of the image forming apparatus 100.

Figure 2:
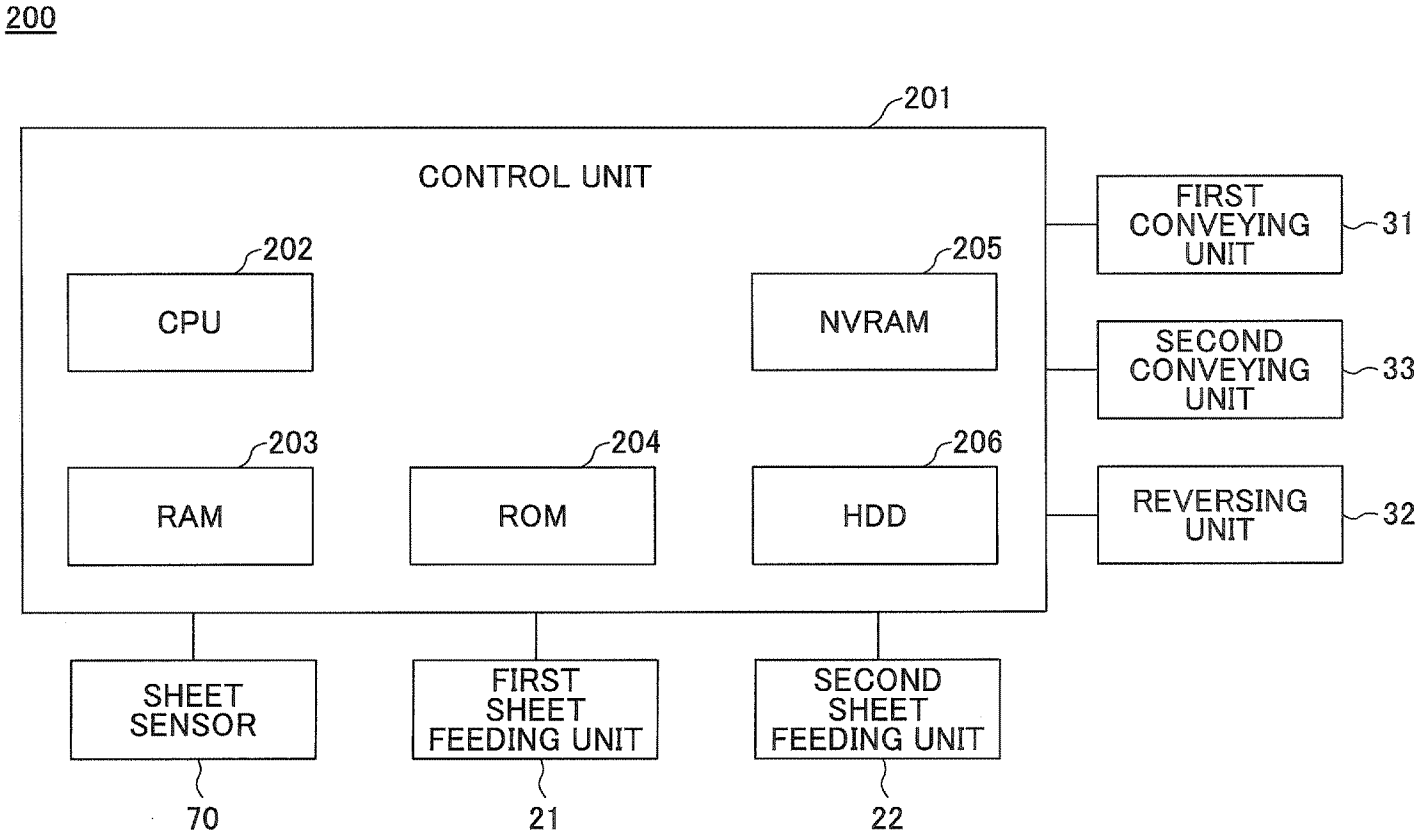
FIG. 2 is a block diagram illustrating a schematic configuration of a conveying apparatus according to an embodiment of the present invention.

FIG. 2 is a block diagram illustrating a schematic configuration of the conveying apparatus 200 according to the present embodiment.

As illustrated in FIG. 2, the conveying apparatus 200 includes a control unit 201, the first sheet feeding unit 21, the second sheet feeding unit 22, the first conveying unit 31, the reversing unit 32, the second conveying unit 33, and the sheet sensor 70.

The control unit 201 includes a CPU 202, a RAM 203, a ROM 204, a NVRAM 205, and a HDD 206, and is configured to control the various component elements of the conveying apparatus 200.

The ROM 204 stores various programs and data used by the various programs. The RAM 203 may be used as a storage area for loading a program or a working area for the loaded program, for example. The CPU 202 implements various functions by processing a program loaded in the RAM 203, for example. The HDD 206 stores various programs and data used by the various programs. The NVRAM 205 stores various setting information and the like.

The control unit 201 feeds a sheet S from the first sheet feeding unit 21 or the second sheet feeding unit 22 according to the print job input to the image forming apparatus 100, and conveys the sheet S to the first conveying unit 31, the reversing unit 32, and the second conveying unit 33. Also, the control unit 201 determines whether a sheet jam has occurred, for example, based on the detection result of the sheet sensor 70.

When performing single-sided printing, the control unit 201 feeds a sheet S from the first sheet feeding unit 21 or the second sheet feeding unit 22, conveys the sheet S to the first conveying unit 31 and the second conveying unit 33, and discharges the sheet S outside the image forming apparatus 100 after printing an image on its first side.

Also, when performing duplex printing, the control unit 201 feeds a sheet S from the first sheet feeding unit 21 or the second sheet feeding unit 22, conveys the sheet S to the first conveying unit 31 and the second conveying unit 33, and reverses the sheet S using the reversing unit 32 after an image has been printed on the first side of the sheet S. After the sheet S has been reversed, the control unit 201 conveys the sheet S once more to the first conveying unit 31 and the second conveying unit 33, and discharges the sheet S outside the image forming apparatus 100 after images have been printed on both of its sides.

Further, when performing sequential duplex printing, the control unit 201 sequentially feeds a plurality of sheets S from the first sheet feeding unit 21 or the second sheet feeding unit 22, and sequentially conveys the sheets S to the first conveying unit 31 and the second conveying unit 33. Then, the control unit 201 newly feeds a sheet S from the first sheet feeding unit 21 or the second sheet feeding unit 22, arranges the newly fed sheet S in between the plurality of sheets S that have images printed on their first sides, and alternates between printing an image on the second side and printing an image on the first side of the sheets S. By performing such interleaf control, productivity may be improved in performing sequential duplex printing in the image forming apparatus 100.

(Duplex Printing Process)

Figure 3:
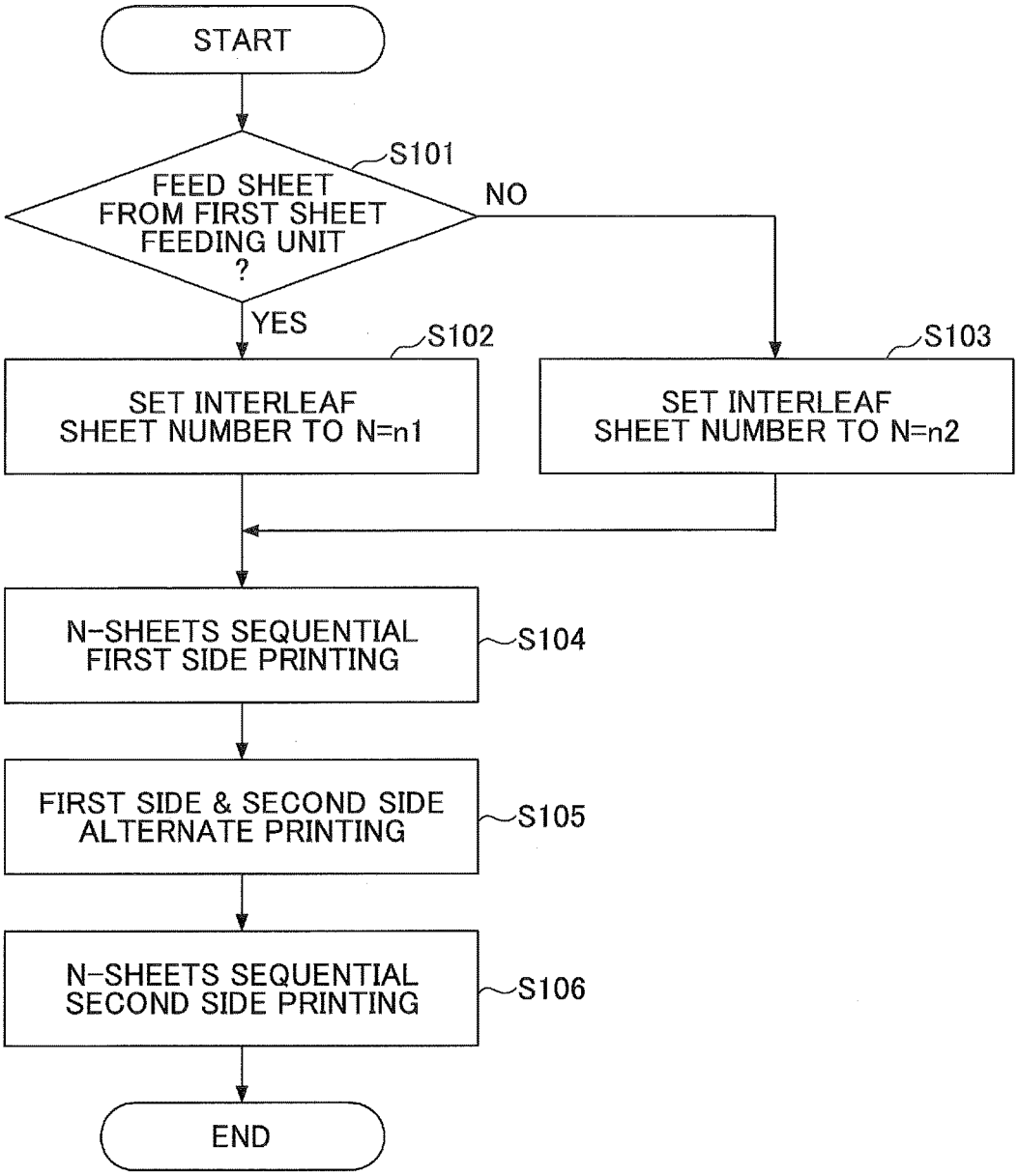
FIG. 3 is a flowchart illustrating a duplex printing process according to an embodiment of the present invention.

FIG. 3 is a flowchart illustrating a duplex printing process according to an embodiment of the present invention.

As illustrated in FIG. 3, when performing sequential duplex printing, in step S101, the control unit 201 of the conveying apparatus 200 determines whether sheets S are to be fed from the first sheet feeding unit 21 or the second sheet feeding unit 22 based on the print job input to the image forming apparatus 100.

In the case of feeding the sheet S from the first feeding unit 21 (step S101, YES), in step S102, the control unit 201 sets the number of interleaf sheets N to n1.

Note that the number of interleaf sheets N refers to the number of sheets S that are to have images sequentially printed on their first sides after sequential duplex printing operations are started. In interleaf control, the number of interleaf sheets N is set according to the number of sheets S that can be arranged at the sheet standby positions along the second conveying unit 33 (second conveying path 330) and the reversing unit 32 (reversing path 320), and the sheet feeding position of the sheets S.

Figure 4:
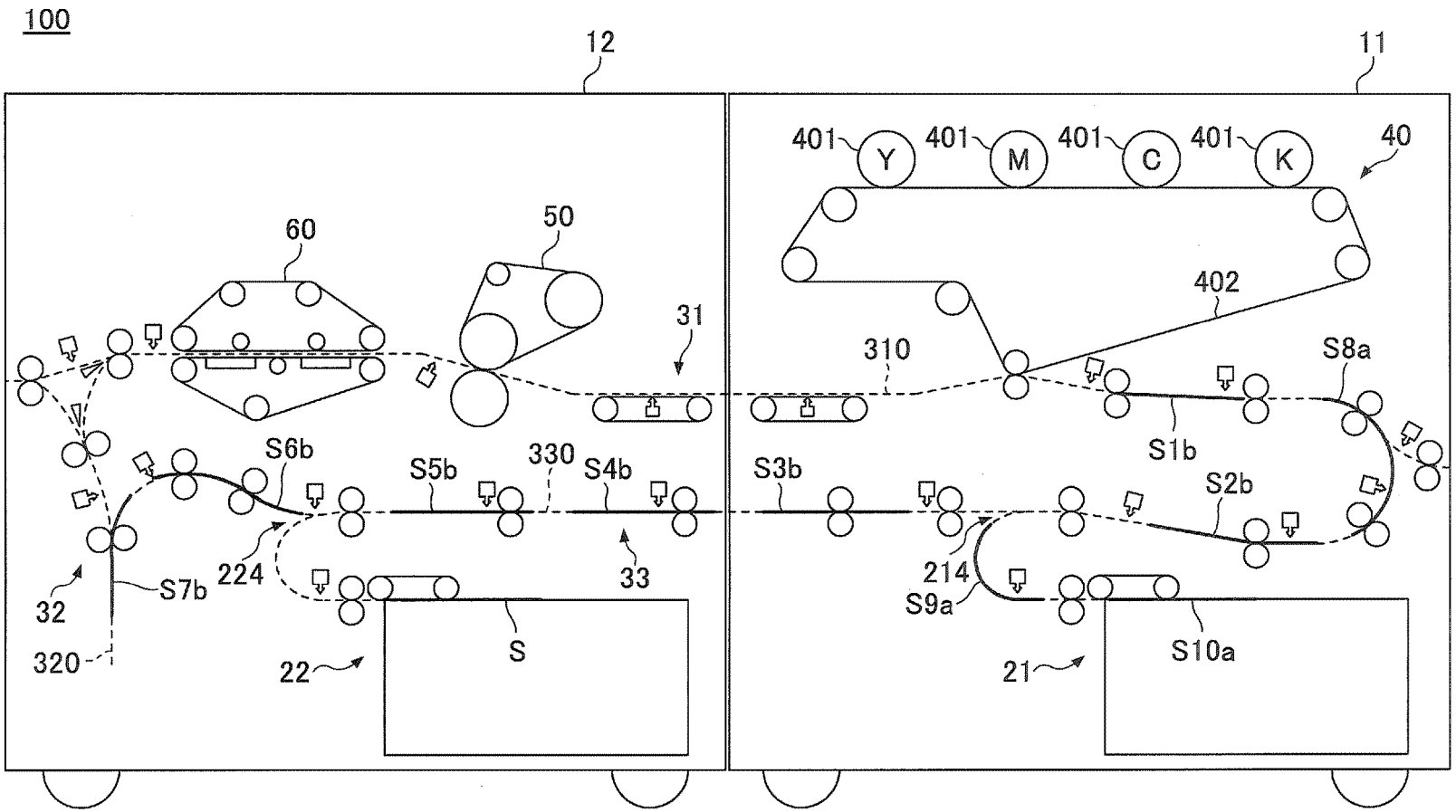
FIG. 4 is a diagram illustrating a sheet conveying state in a case of performing sequential duplex printing on sheets that are fed from a first sheet feeding unit according to an embodiment of the present invention.

FIG. 4 is a diagram illustrating a sheet conveying state in the case of performing sequential duplex printing on sheets S that are fed from the first sheet feeding unit 21.

As illustrated in FIG. 4, in the image forming apparatus 100 according to the present embodiment, eight sheets S can be arranged to wait at the sheet standby positions along the second conveying unit 33 and the reversing unit 32. Also, the first sheet feeding unit 21 is configured to feed a sheet S to the first sheet feeding position 214 that is between a third sheet standby position and a fourth sheet standby position of the sheet standby positions for the sheets S counting from the foremost sheet standby position in the conveying direction of the second conveying unit 33.

Thus, in the case of performing sequential duplex printing by feeding sheets S from the first sheet feeding unit 21, the control unit 201 of the conveying apparatus 200 feeds sheet S8*a* between first-side-printed sheet S1*b* and first-side-printed sheet S2*b* that already have images printed on their first sides, and controls first-side-printed sheets S3*b*-S7*b* to wait at their sheet standby positions.

Thus, in the case of performing interleaf control by feeding sheets S from the first sheet feeding unit 21 in the image forming apparatus 100 according to the present embodiment, seven first-side-printed sheets S (sheets S1*b*-S7*b*) can be arranged to wait at the sheet standby positions along the first conveying unit 33 and the reversing unit 32. Thus, in the case of performing sequential duplex printing by feeding sheets S from the first sheet feeding unit 21 in the image forming apparatus 100 according to the present embodiment, the control unit 201 sets the number of interleaf sheets N to n1=7 sheets.

Figure 5:
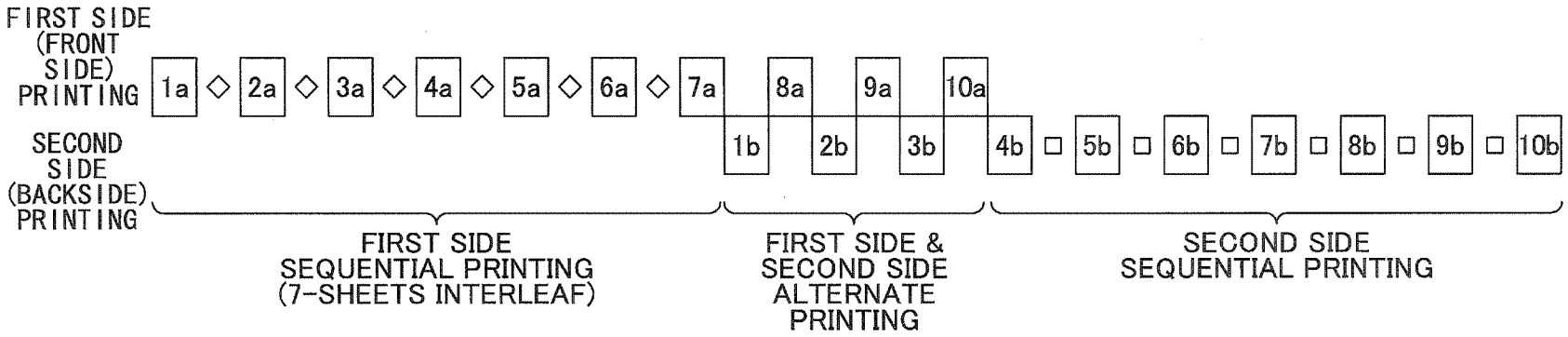
FIG. 5 is a diagram illustrating an exemplary case of performing sequential duplex printing on sheets that are fed from the first sheet feeding unit according to an embodiment of the present invention.

According to such a setting, for example, in the case of performing sequential duplex printing by feeding ten sheets S from the first sheet feeding unit 21, as illustrated in FIG. 5, first side printing is sequentially performed on the first seven sheets S1*a*-S7*a* that are fed from the first feeding unit 21.

Then, second side printing of the first-side-printed sheets S1*b*-S3*b* (corresponding to the sheets S1*a*-S3*a* that have been reversed by the reversing unit 32) and first side printing of sheets S8*a*-S10*a* that are newly fed from the first sheet feeding unit 21 are alternately performed. Then, second side printing is sequentially performed on the first-side-printed sheets S4*b*-S10*b*, and in this way, sequential duplex printing on the ten sheets may be completed.

Note that in the case of performing sequential printing on more than ten sheets, the extra sheets S fed from the first sheet feeding unit 21 may be arranged in between the sheets S4*b*-S10*b* of FIG. 5, and first side printing and second side printing may continue to be alternately performed.

Referring back to the flowchart of FIG. 3, in the case where sequential duplex printing is to be performed by feeding sheets S from the second feeding unit 22 (step S101, NO), in step S103, the control unit 201 sets the number of interleaf sheets N to n2.

Figure 6:
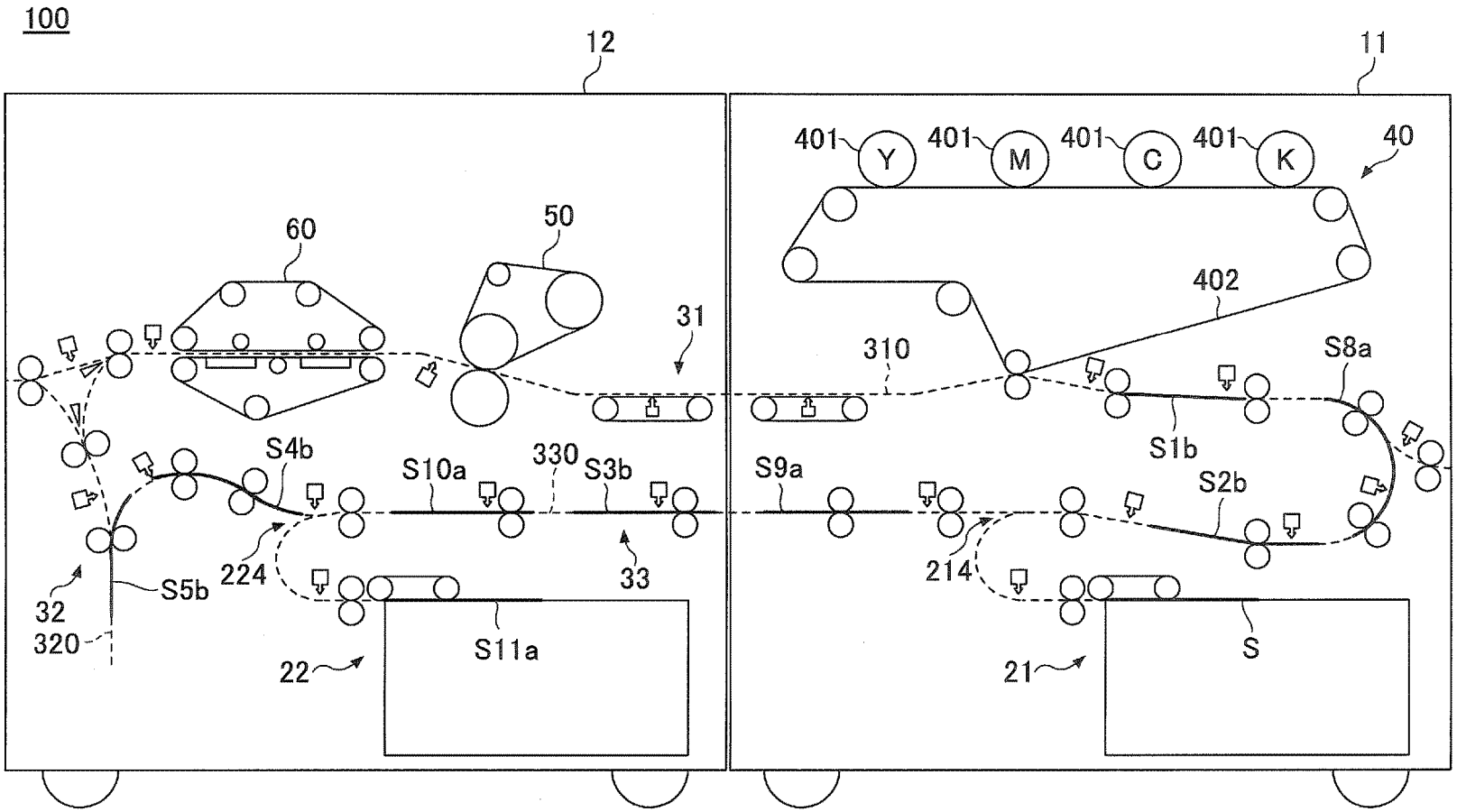
FIG. 6 is a diagram illustrating a sheet conveying state in a case of performing sequential duplex printing on sheets that are fed from a second sheet feeding unit according to an embodiment of the present invention.

FIG. 6 is a diagram illustrating a sheet conveying state in the case of performing sequential duplex printing on sheets S that are fed from the second sheet feeding unit 22.

As illustrated in FIG. 6, in the image forming apparatus 100 according to the present embodiment, eight sheets S can be arranged to wait at sheet standby positions along the second conveying unit 33 and the reversing unit 32. Also, the second sheet feeding unit 22 is configured to feed sheets S to the second sheet feeding position 224 that is between the sixth sheet standby position and the seventh sheet standby position of the standby positions for the sheets S counting from the foremost sheet standby position in the conveying direction of the second conveying unit 33.

Thus, in the case of performing sequential duplex printing by feeding sheets S from the second sheet feeding unit 22, the control unit 201 of the conveying apparatus 200, feeds sheet S8*a* between first-side-printed sheets S1*b* and S2*b* that already have images printed on their first sides. Also, the control unit 201 feeds sheet 9Sa between first-side-printed sheets S2*b* and S3*b*, feeds sheet S10*a* between first-side-printed sheets S3*b* and S4*b*, and controls first-side-printed sheets S4*b* and S5*b* to wait at their standby positions.

Thus, in the case of performing interleaf control by feeding sheets S from the second sheet feeding unit 22 in the image forming apparatus 100 according to the present embodiment, five first-side-printed sheets S (sheets S1*b*-S5*b*) can be arranged to wait at the sheet standby positions along the second conveying unit 33 and the reversing unit 32. Thus, in the case of performing sequential duplex printing by feeding sheets S from the second sheet feeding unit 22 in the image forming apparatus 100 according to the present embodiment, the control unit 201 sets the number of interleaf sheets N to n2=5 sheets.

Figure 7:
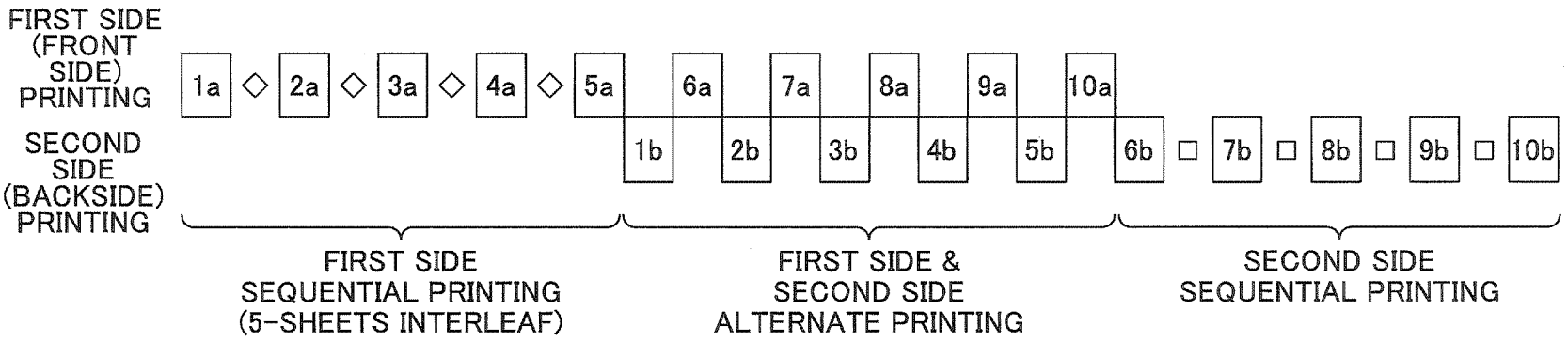
FIG. 7 is a diagram illustrating an exemplary case of performing sequential duplex printing on sheets that are fed from the second sheet feeding unit according to an embodiment of the present invention.

According to such a setting, for example, in the case of performing sequential duplex printing on ten sheets S that are fed from the second sheet feeding unit 22, as illustrated in FIG. 7, first side printing is sequentially performed on the first five sheets S1*a*-S5*a* that are fed from the second feeding unit 22.

Then, second side printing of the first-side-printed sheets S1*b*-S5*b* (corresponding to the sheets S1*a*-S5*a* that have been reversed by the reversing unit 32) and first side printing of five sheet S6*a*-S10*a* that are newly fed from the second sheet feeding unit 22 are alternately performed. Then, second side printing of the first-side-printed sheets S6*b*-S10*b* is sequentially performed, and in this way, sequential duplex printing on the ten sheets may be completed.

Note that in the case of performing sequential duplex printing on more than ten sheets, the extra sheets S fed from the second sheet feeding unit 22 may be arranged in between the sheets S6*b*-S10*b* of FIG. 7, and second side printing and first side printing may continue to be alternately performed.

Referring back to the flowchart of FIG. 3, after the number of interleaf sheets N is set up in step S102 or step S103 as described above, in step S104, images are sequentially printed on the first sides of sheets S for the set number of interleaf sheets N. Then, in step S105, second side printing of a sheet S already having an image formed on its first side and first side printing of a sheet S fed from the first feeding unit 21 or the second sheet feeding unit 22 are alternately performed.

Then, in step S106, second side printing of the sheets S already having images printed on their first sides is sequentially performed, and in this way, sequential duplex printing at the image forming apparatus 100 may be completed.

The image forming apparatus 100 according to the present embodiment includes the first sheet feeding unit 21 and the second sheet feeding unit 22, and at least one sheet standby position for the sheet S is arranged between the first sheet feeding position 214 of the first sheet feeding unit 21 and the second sheet feeding position 224 of the second sheet feeding unit 22. When performing sequential duplex printing through interleaf control in the image forming apparatus 100 having such a configuration, the number of first-side-printed sheets S that can be arranged to wait at the sheet standby positions along the second conveying unit 33 and the reversing unit 32 varies depending on whether the sheets S are fed from the first sheet feeding unit 21 or the second sheet feeding unit 22.

Thus, as described above, when performing sequential duplex printing through interleaf control, the number of interleaf sheets N has to be changed depending on whether the sheets S are fed from the first sheet feeding unit 21 or the second sheet feeding unit 22. Specifically, because the second sheet feeding position 224 of the second sheet feeding unit 22 is arranged at the upstream side of the second conveying path 330 of the second conveying unit 33, in the case where the sheets S are fed from the second sheet feeding unit 22, the control unit 201 sets the number of interleaf sheets N to a smaller number as compared to the case where the sheets S are fed from the first sheet feeding unit 21.

By having the control unit 201 change the number of interleaf sheets N as described above, conveying control may be optimized with respect to each of a plurality of sheet feeding units and productivity may be improved in performing sequential duplex printing at the image forming apparatus 100.

As described above, in the image forming apparatus 100 according to the present embodiment, when performing sequential duplex printing, the control unit 201 changes the number of interleaf sheets N depending on whether sheets S are fed from the first sheet feeding unit 21 or sheets S are fed from the second sheet feeding unit 22. By having the control unit 201 change the number of interleaf sheets N in this manner, conveying control and productivity may be optimized in each of the case where sheets S are fed from the first sheet feeding unit 21 and the case where sheets S are fed from the second sheet feeding unit 22.

Although a conveying apparatus, an image forming apparatus, and a conveying control method according to the present invention have been described above with respect to certain illustrative embodiments, the present invention is not limited to the above embodiments, and various variations and modifications may be made within the scope of the present invention.

For example, the first conveying unit 31, the reversing unit 32, and the second conveying unit 33 may have configurations that vary from the present embodiment. Also, the number of standby positions for the sheets S provided along the reversing unit 32 and the second conveying unit 33 may be different from the present embodiment, for example. Also, the first sheet feeding position 214 of the first sheet feeding unit 21 and the second sheet feeding position 224 of the second sheet feeding unit 22 may be provided at positions different from the present embodiment, for example. Also, the image forming apparatus 100 may include three or more sheet feeding units configured to feed sheets S at different sheet feeding positions, and in performing sequential duplex printing, the control unit 201 may set a different number of interleaf sheets N with respect to each of the sheet feeding units, for example.

Note that depending on the length in the conveying direction for the sheets S, even in cases where sheets S are fed from different sheet feeding units, the number of first-side-printed sheets S already having images printed on their first sides that can be arranged to wait along the reversing/ conveying path may be the same number. In such a case, the control unit 201 may set the same number of interleaf sheets N regardless of the sheet feeding position of the sheets S.

The present application is based on and claims the benefit of priority of Japanese Patent Application No. 2014-215397 filed on Oct. 22, 2014, the entire contents of which are hereby incorporated by reference.

What is claimed is:

1. A conveying apparatus comprising:

a first conveying unit configured to convey a recording medium;

a reversing unit configured to reverse the recording medium conveyed by the first conveying unit;

a second conveying unit configured to convey the recording medium along a conveying path from the reversing unit to the first conveying unit;

a first supply unit configured to supply the recording medium to the second conveying unit at a first supply position;

a second supply unit configured to supply the recording medium to the second conveying unit at a second supply position; and a control unit configured to control the conveying apparatus, upon sequentially reversing and conveying a plurality of sheets of the recording medium, to alternately convey the recording medium reversed by the reversing unit and the recording medium that is supplied from the first supply unit or the second supply unit after a predetermined number of sheets of the recording medium have been reversed by the reversing unit;

wherein the control unit is configured to change the predetermined number depending on:

whether the recording medium is supplied from the first supply unit or the recording medium is supplied from the second supply unit, and the number of sheets of the recording medium that are to have images sequentially printed on a first side of the recording medium after the conveying apparatus has sequentially reversed and conveyed the plurality of sheets of the recording medium.

2. The conveying apparatus as claimed in claim 1, wherein the second conveying unit includes a plurality of standby positions at which the recording medium can be positioned to wait; and the second supply position of the second supply unit is positioned upstream with respect to the first supply position of the first supply unit, and at least one of the plurality of standby positions is arranged between the first supply position and the second supply position.

3. The conveying apparatus as claimed in claim 2, wherein in a case where the recording medium is supplied from the second supply unit, the control unit sets the predetermined number to a second number that is less than a first number to be set up as the predetermined number in a case where the recording medium is supplied from the first supply unit.

4. An image forming apparatus comprising:

an image forming unit configured to form an image on a recording medium that is conveyed by a first conveying unit; and a conveying apparatus that includes the first conveying unit configured to convey the recording medium;

a reversing unit configured to reverse the recording medium that is conveyed by the first conveying unit;

a second conveying unit configured to convey the recording medium along a conveying path from the reversing unit to the first conveying unit;

a first supply unit configured to supply the recording medium to the second conveying unit at a first supply position;

a second supply unit configured to supply the recording medium to the second conveying unit at a second supply position; and a control unit configured to control the conveying apparatus, upon sequentially reversing and conveying a plurality of sheets of the recording medium, to alternately convey the recording medium that has been reversed by the reversing unit and the recording medium that is supplied from the first supply unit or the second supply unit after a predetermined number of sheets of the recording medium have been reversed by the reversing unit;

wherein the control unit is configured to change the predetermined number depending on:

whether the recording medium is supplied from the first supply unit or the recording medium is supplied from the second supply unit, and the number of sheets of the recording medium that are to have images sequentially printed on a first side of the recording medium after the conveying apparatus has sequentially reversed and conveyed the plurality of sheets of the recording medium.

5. The image forming apparatus as claimed in claim 4, wherein the second conveying unit includes a plurality of standby positions at which the recording medium can be positioned to wait; and the second supply position of the second supply unit is positioned upstream with respect to the first supply position of the first supply unit, and at least one of the plurality of standby positions is arranged between the first supply position and the second supply position.

6. The image forming apparatus as claimed in claim 5, wherein in a case where the recording medium is supplied from the second supply unit, the control unit sets the predetermined number to a second number that is less than a first number to be set up as the predetermined number in a case where the recording medium is supplied from the first supply unit.

7. A conveying control method for controlling a conveying apparatus that includes a first conveying unit configured to convey a recording medium;

a reversing unit configured to reverse the recording medium that is conveyed by the first conveying unit;

a second conveying unit configured to convey the recording medium along a conveying path from the reversing unit to the first conveying unit;

a first supply unit configured to supply the recording medium to the second conveying unit at a first supply position; and a second supply unit configured to supply the recording medium to the second conveying unit at a second supply position;

the conveying control method comprising:

a control step for controlling the conveying apparatus, upon sequentially reversing and conveying a plurality of sheets of the recording medium, to alternately convey the recording medium that has been reversed by the reversing unit and the recording medium that is supplied from the first supply unit or the second supply unit after a predetermined number of sheets of the recording medium has been reversed by the reversing unit;

wherein the control unit is configured to change the predetermined number depending on:

whether the recording medium is supplied from the first supply unit or the recording medium is supplied from the second supply unit, and the number of sheets of the recording medium that are to have images sequentially printed on a first side of the recording medium after the conveying apparatus has sequentially reversed and conveyed the plurality of sheets of the recording medium.

* * * * *